US008458934B2

(12) United States Patent
O'Donoghue

(10) Patent No.: US 8,458,934 B2
(45) Date of Patent: Jun. 11, 2013

(54) CONCAVE INFORMATION DISPLAY UNIT

(76) Inventor: Colin O'Donoghue, London (GB)

( * ) Notice: Subject to any disclaimer, the term of this patent is extended or adjusted under 35 U.S.C. 154(b) by 0 days.

(21) Appl. No.: 13/265,168

(22) PCT Filed: May 4, 2010

(86) PCT No.: PCT/GB2010/000902
§ 371 (c)(1),
(2), (4) Date: Oct. 19, 2011

(87) PCT Pub. No.: WO2010/128293
PCT Pub. Date: Nov. 11, 2010

(65) Prior Publication Data

US 2012/0036746 A1 Feb. 16, 2012

(30) Foreign Application Priority Data

May 5, 2009 (GB) ..... 0907716.5

(51) Int. Cl.
*G09F 1/08* (2006.01)
*G09F 15/00* (2006.01)

(52) U.S. Cl.
USPC ..... 40/539; 40/610; 40/124.14

(58) Field of Classification Search
USPC ..... 40/539, 650, 606.12, 738, 610, 124.16; 229/116.1; D9/710; 312/259
See application file for complete search history.

(56) References Cited

U.S. PATENT DOCUMENTS

| | | | | | |
|---|---|---|---|---|---|
| 3,845,897 | A * | 11/1974 | Buttery et al. | ..... | 229/117 |
| 4,776,460 | A * | 10/1988 | Hoffman | ..... | 206/69 |
| 5,249,771 | A * | 10/1993 | Wear | ..... | 248/317 |
| 7,159,351 | B2 * | 1/2007 | Sparkowski | ..... | 40/610 |
| 7,520,071 | B2 * | 4/2009 | Abramson | ..... | 40/538 |

* cited by examiner

*Primary Examiner* — Joanne Silbermann

(57) ABSTRACT

A display unit comprising of at least one display sheet of a substantially rigid and foldable material divided into a plurality of panels by crease and/or score lines that when erected forms a display unit with at least one concave presentation face.

7 Claims, 16 Drawing Sheets

Figure 15:
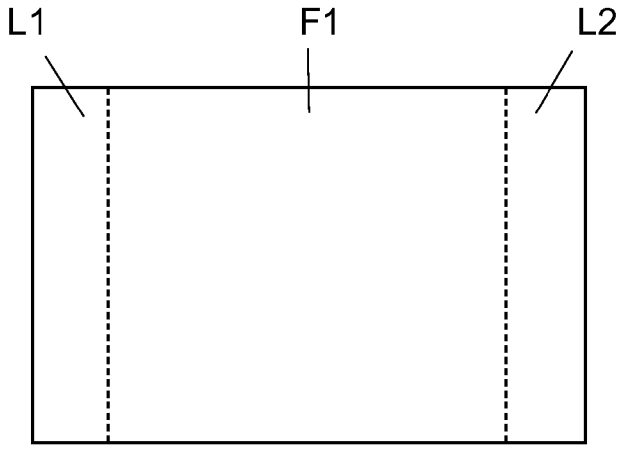

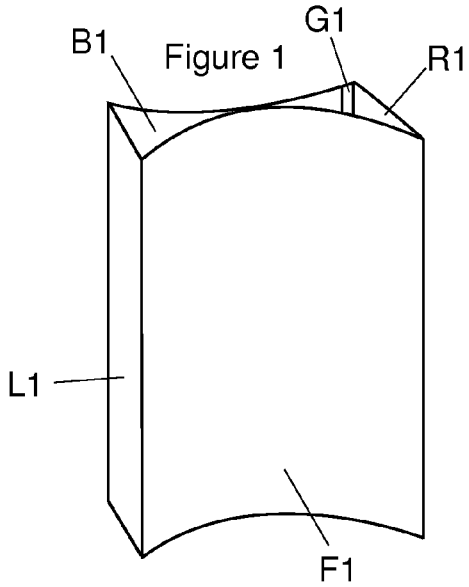
Figure 1
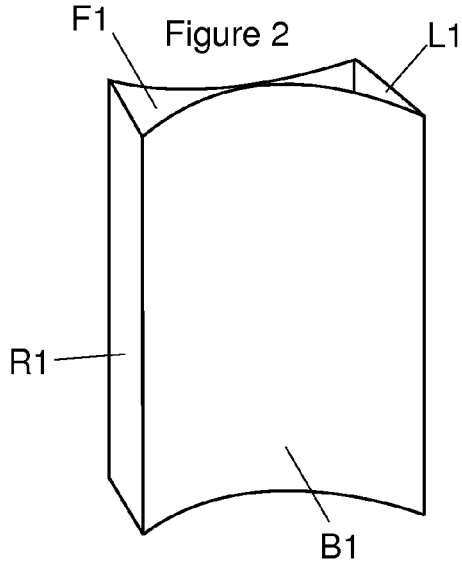
Figure 2
Figure 3
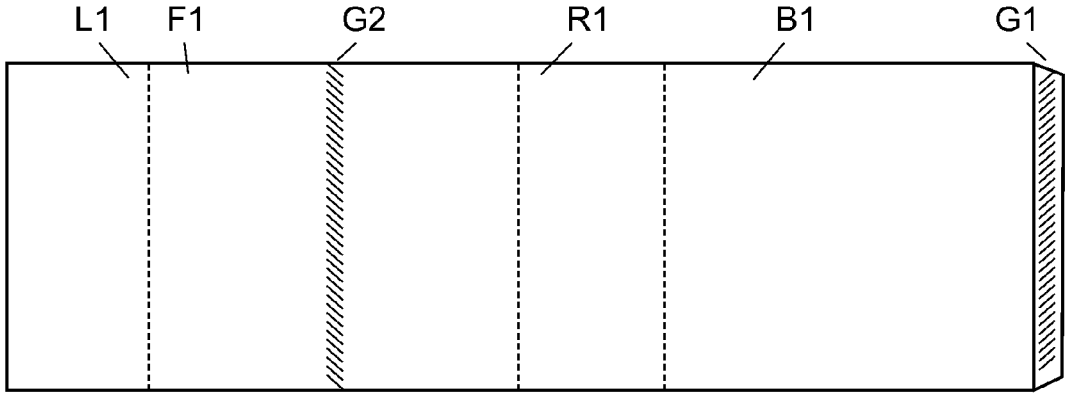

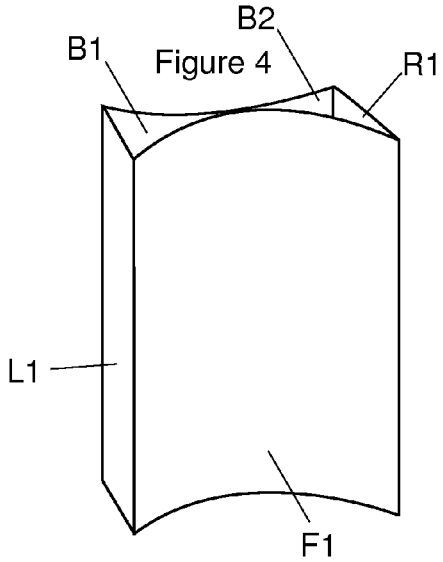
Figure 4
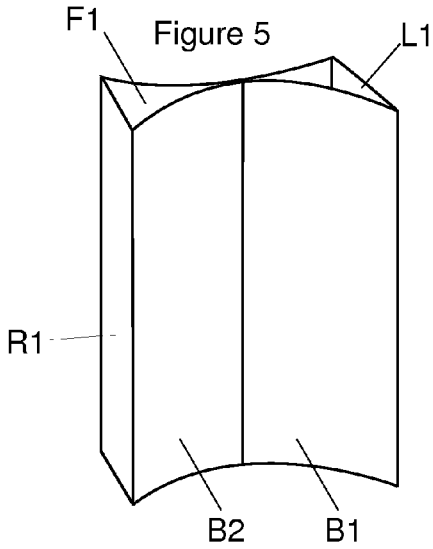
Figure 5
Figure 6
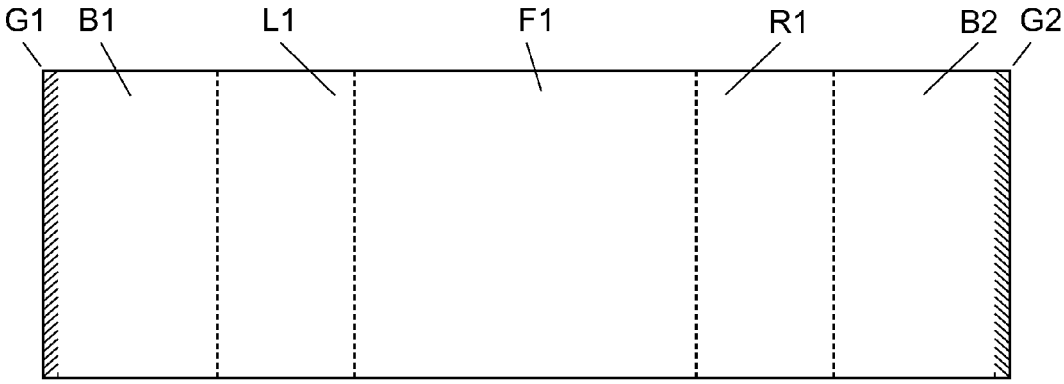

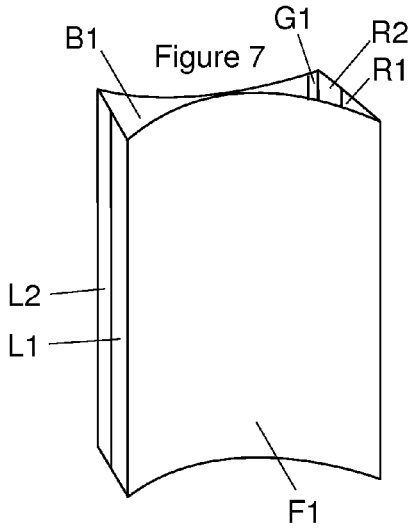
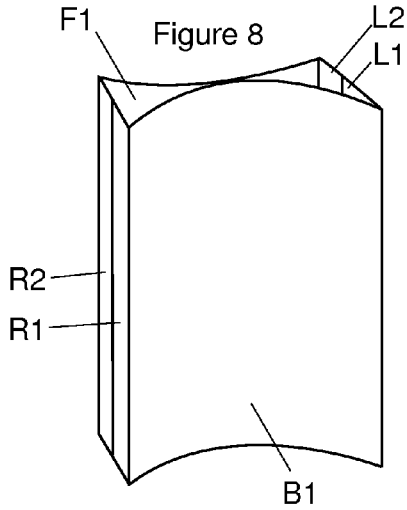
Figure 9
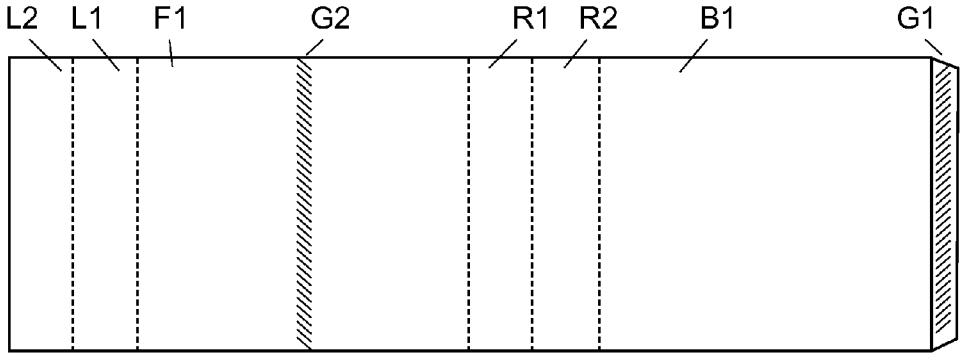
Figure10
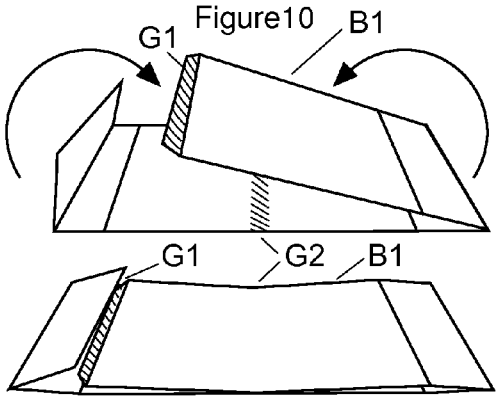

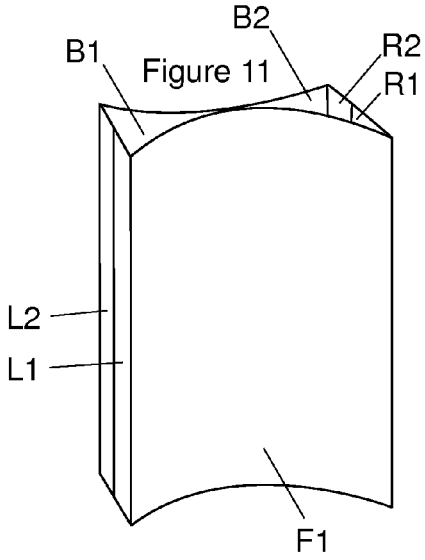
Figure 11
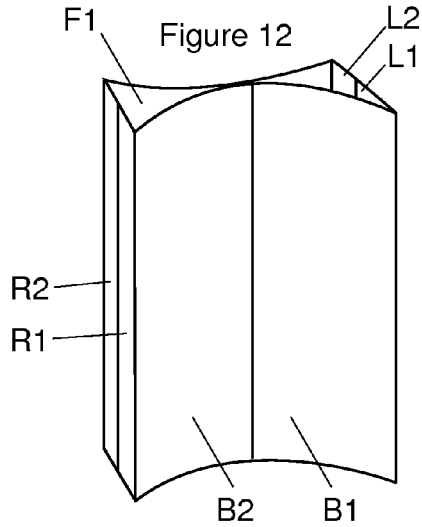
Figure 12
Figure 13
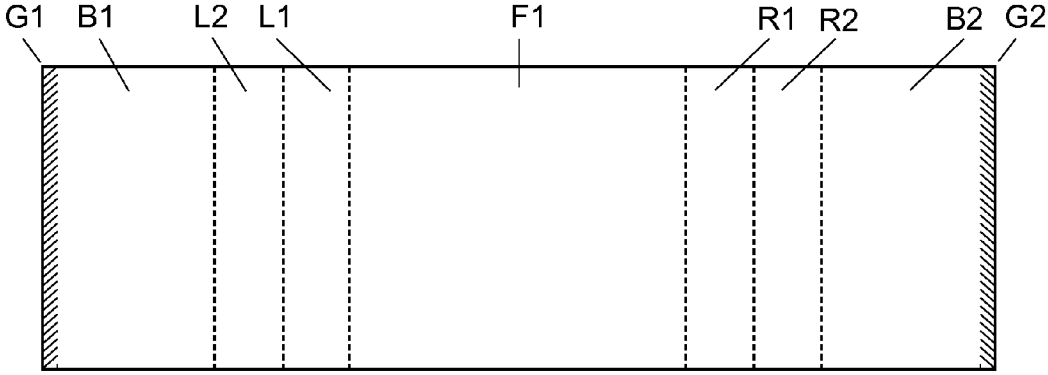
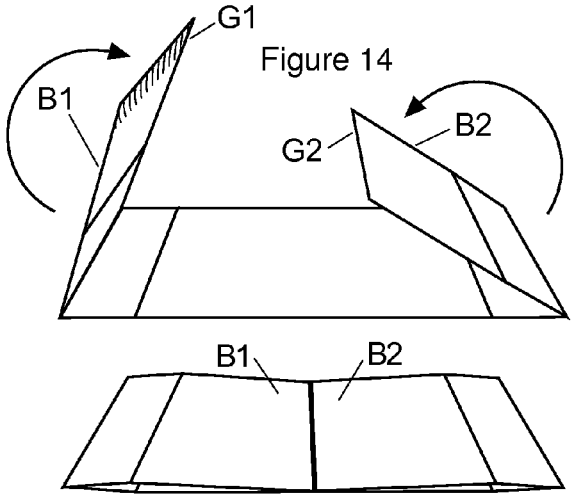
Figure 14

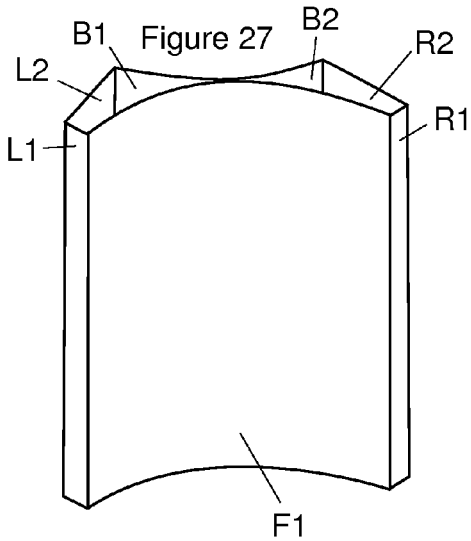
Figure 27
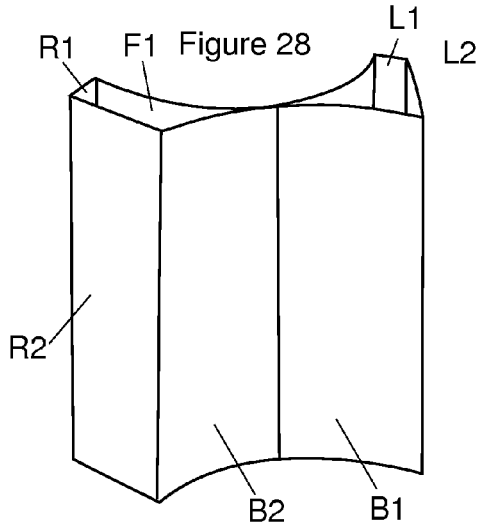
Figure 28
Figure 29
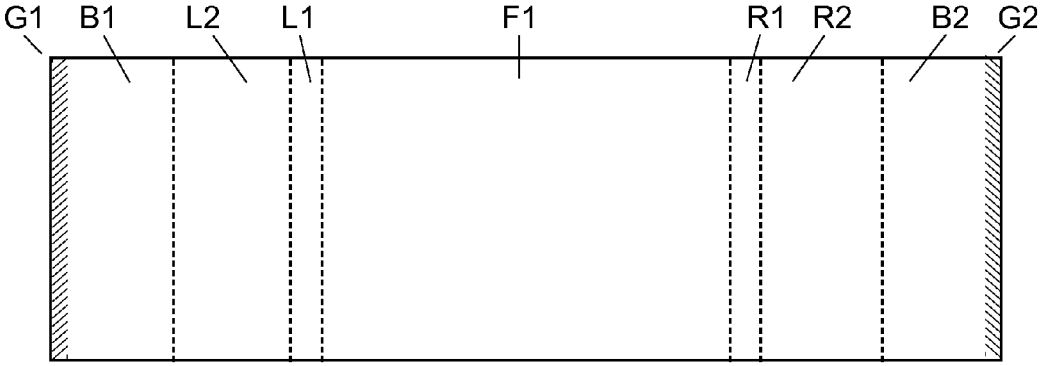
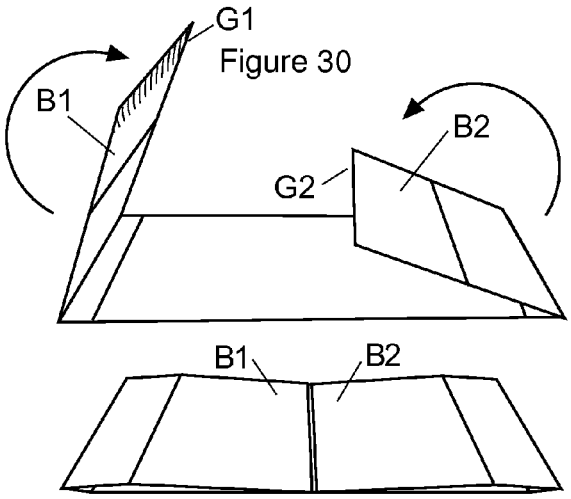
Figure 30

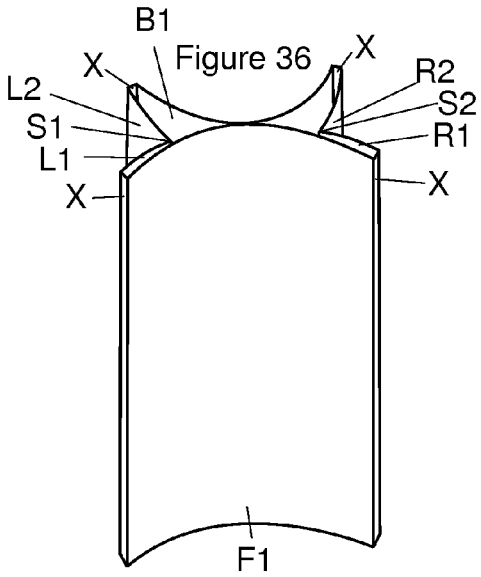
Figure 36
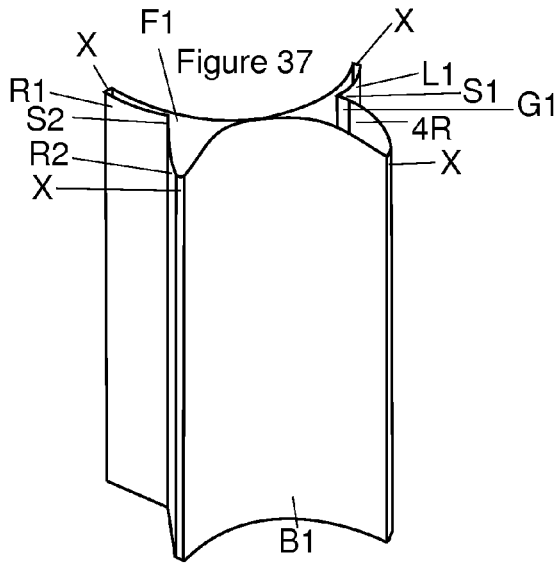
Figure 37
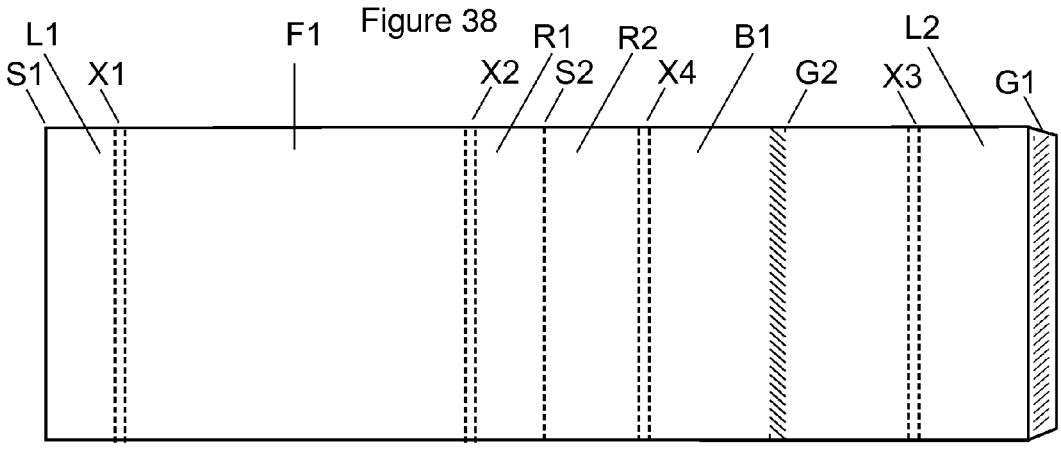
Figure 38
Figure 39
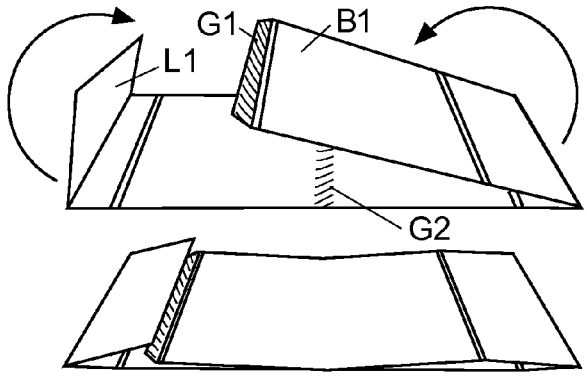

CONCAVE INFORMATION DISPLAY UNIT

An information support unit having at least one concave presentation face.

INTRODUCTION AND BACKGROUND TO THE INVENTION

The present invention relates to a display unit comprised of at least one display sheet of a substantially rigid and foldable material divided into a plurality of panels by crease and/or score lines that form a display unit with at least one concave presentation face.

Typically a device used in counter and window displays to enhance or describe a product placed in front of it is a flat sheet of cardboard of substantial thickness, held vertically by a supporting strut or device attached to the back. These displays or showcards are often used to associate the product with an aspirational image printed on the display. Because of the thickness of board required to maintain a rigid state, printing is generally restricted to the silkscreen process applied directly to the board or to a lithographic label, which is then laminated to the board.

Unlike the typical flat display unit, the invention surrounds and visually embraces an object placed in front of it. The concave display is self-supporting by virtue of curved panels and may be produced out of thin material that may be printed lithographically to economically achieve high quality print and also may be automatically folded and glued on standard box making equipment.

Larger floor standing displays are used at trade exhibitions and at retail to carry a promotional message. They are required to be cheap to produce and easy to erect and many versions are in the market place including flat vertical display boards with supporting struts. Convex display towers such as that disclosed in EP1395971 Francois L'Hotel are also available.

The film industry uses substantial point of sale devices, including flat and convex displays, to promote films in cinema foyers. A cheap concave free-standing floor display unit, which may appear to mimic a panoramic cinema screen is a natural alternative for the promotion of films as well as products like cosmetics that want to be associated with the glamour of the big screen or a vista, like the cruise liner trade.

STATEMENT OF INVENTION

This invention relates to a concave display unit formed from at least one sheet of foldable and bendable material subdivided into panels to form a front panel, a rear panel, the front panel being at least partially attached to the rear panel, and a pair of opposing sets of side panels, each set of side panels comprising a front side panel and a rear side panel, wherein the front panel and rear panel are of different widths and the front side panels are of different widths to the rear side panels to provide a concave display unit which is collapsible for transport and expandable having concave front and rear panels for display.

When assembled or when erected from a collapsed state tensions created in the material produce a concave Front Panel for display attached at the centre to the Rear Panel, which may also be forced into a concave form.

The device allows three basic variants, which in turn have a number of variants. Although extra panels may be employed all variants rely for their geometry on a left panel that may be divided into two or more panels, a right panel that may be divided into two or more panels, a Rear Panel that may be divided into a Left Rear Half Panel and a Right Rear Half Panel to aid automated manufacture and a Front Panel. In all variants, the Front Panel is attached to the Rear Panel via the side panels and in addition the back of the Rear Panel is attached directly or indirectly to the back of the Front Panel in such a way that when erected the Front Panel is forced into a concave curve and the Rear Panel may also be forced into a concave curve.

PRIOR ART

Variant One (Front View FIG. 1, Rear View FIG. 2, Panel Layout FIG. 3)

Figure 48:
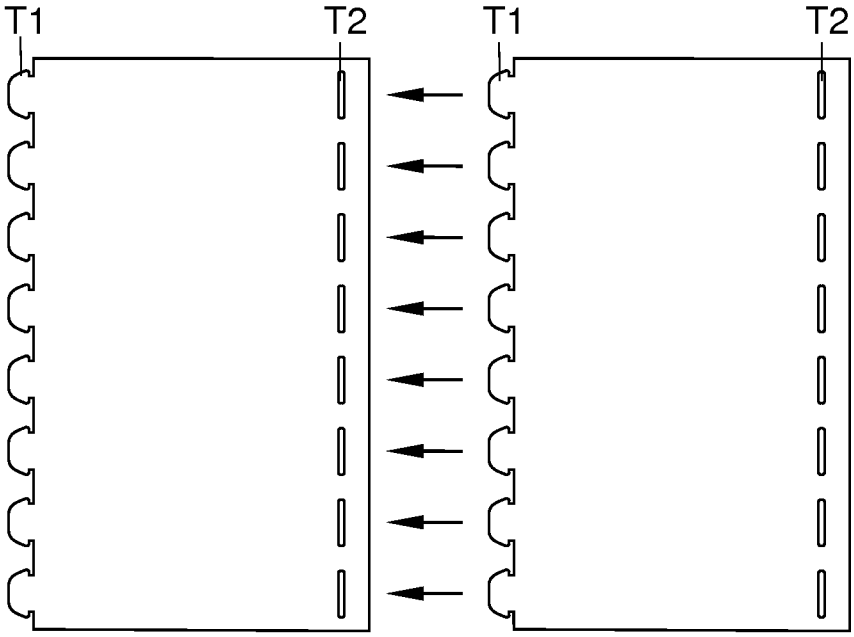

This embodiment employs a Front Panel (F1) and a Rear Panel (B1) and a Left Side Panel (L1) and a Right Side Panel (R1). When assembled this configuration creates a rigid display that cannot be collapsed by virtue of the Front Panel (F1) being fixed to the Rear Panel (R1) by the Side Panels (L1 and R1) and the centre Glue Seam (G2 FIG. 3) fixing the back of the Front Panel to the back of the Rear Panel. The Rear Panel (B1) may be attached to the Left Side Panel (L1) by a Glue Seam Panel (G1 FIG. 1 and FIG. 3) or a Tab and Slot device (FIG. 48) or any other joining device.

Variant Two (Front View FIG. 4, Rear View FIG. 5, Panel Layout FIG. 6)

This embodiment is the same as Variant One but has no Glue Panel, instead the Rear Panel is divided vertically down the middle into a Left Rear Panel (B1) and a Right Rear Panel (B2) that are folded over and fixed to the back of the Front Panel (F1) at points along the Glue Seams or along the entire length of the Glue Seams (G1 and G2, FIG. 6).

Figure 16:
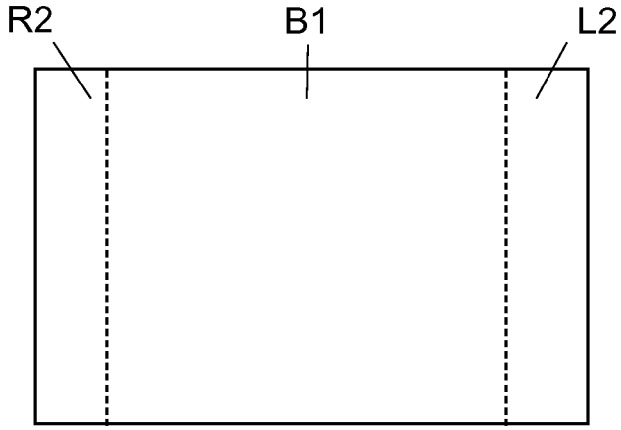
Figure 18:
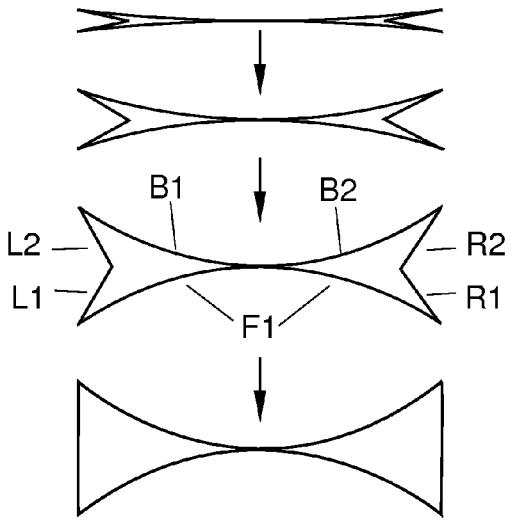
Figure 19:
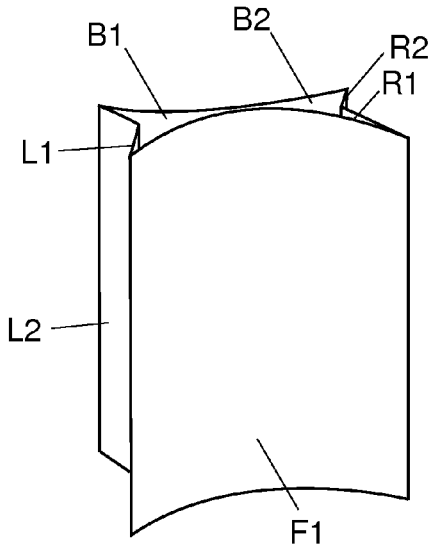
Figure 20:
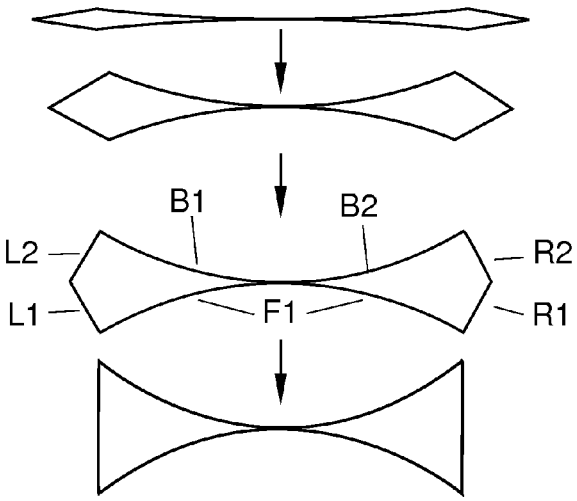
Figure 21:
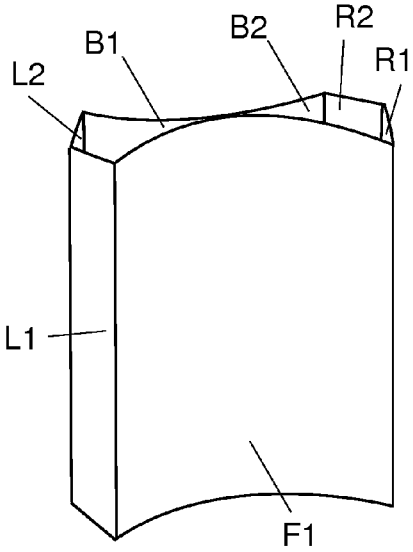
Figure 22:
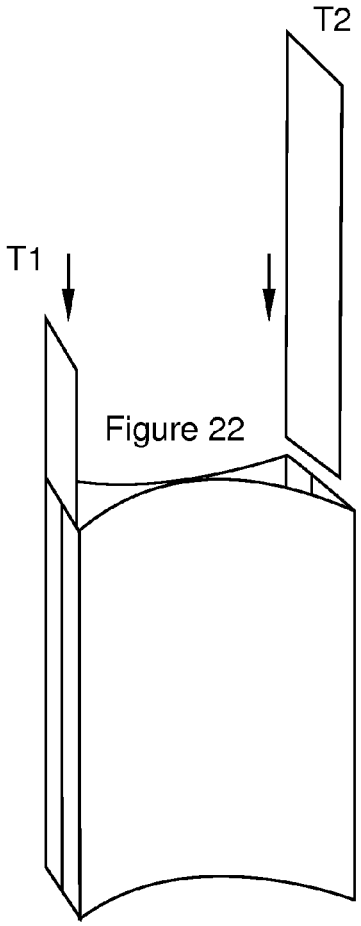

Variant Three (Front View FIG. 7, Rear View FIG. 8, Panel Layout FIG. 9, Flat Assembly Diagram FIG. 10, Flat Front Panels FIG. 15, Flat Rear Panels FIG. 16, Concertina Spring-Up Fold FIG. 18 and FIG. 19, Flat Outward Fold FIG. 20 and FIG. 21, Rigid Members FIG. 22)

This embodiment is the same as Variant One but divides the side panels in Variant One into two Front Side Panels (L1 and R1) of equal width to two Rear Side Panels (L2 and R2) so that they may be folded inwards, concertina style (FIG. 9 and FIG. 11) and which may allow the unit to automatically erect in a pop-up fashion using the tensions in the board created by the concertina fold when the display is released from its outer packaging. This variant may also be produced with the side panels (L1, L2, R1, R2) folded outwards (FIG. 10 and FIG. 12) to allow the display to lie flat for transit without requiring outer packaging to prevent it auto-erecting. In this case the side panels are pushed inwards to erect the display. The display may be joined together by a Glue Panel (FIG. 5 G1) or tab and slot panel device (FIG. 48) or any other joining device.

Figure 17:
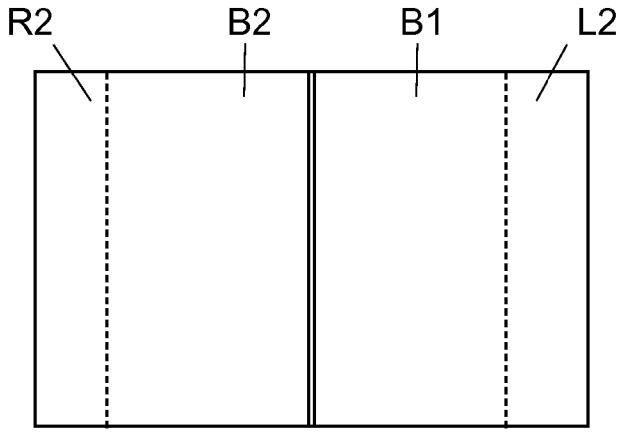

Variant Four (Front View FIG. 11, Rear View FIG. 12, Panel Layout FIG. 13, Flat Assembly Diagram FIG. 14, Flat Front Panels FIG. 15, Flat Rear Panels FIG. 17)

This embodiment is the same as Variant Three but has no Glue Panel, instead the Rear Panel is divided vertically down the middle into a Left Rear Panel (B1) and a Right Rear Panel (B2) that are folded over and fixed to the back of the Front Panel (F1) at points along the Glue Seams or along the entire length of the Glue Seams (G1 and G2, FIG. 13) to aid automated manufacture.

EMBODIMENTS OF THE INVENTION

Figure 23:
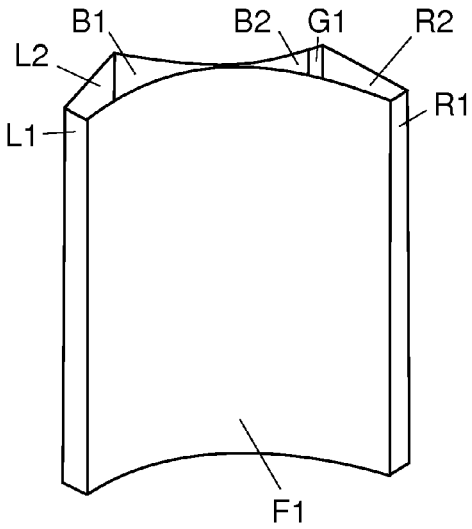
Figure 24:
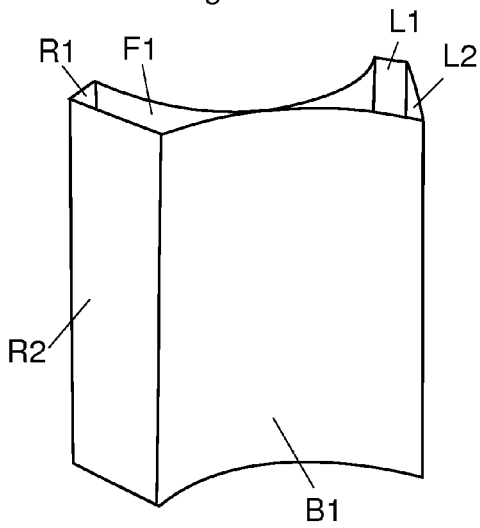
Figure 25:
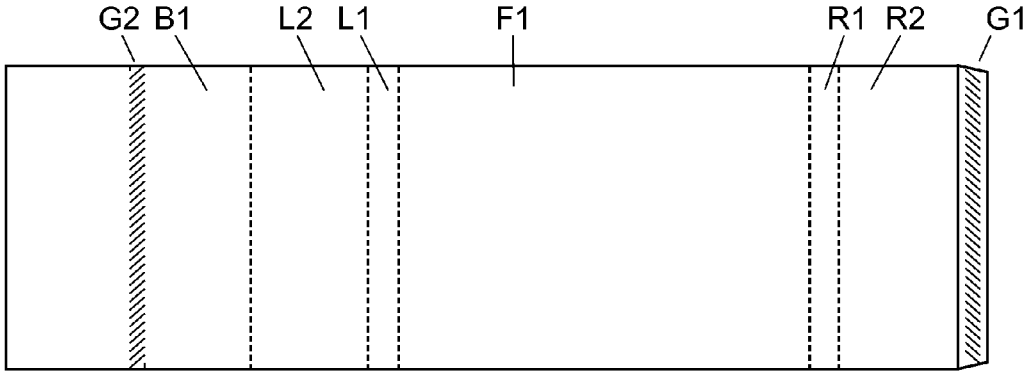
Figure 26:
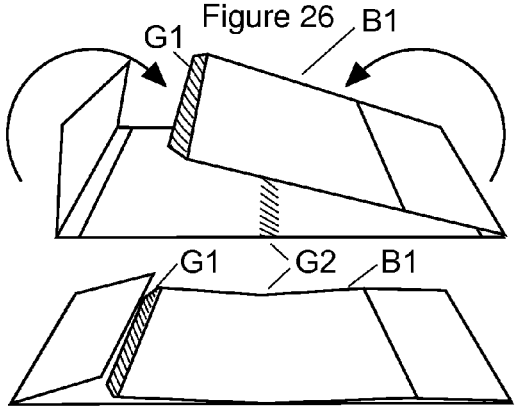

Embodiment One (Front View FIG. 23, Rear View FIG. 24, Panel Layout FIG. 25, Flat Assembly Diagram FIG. 26, Front Panels Folded FIG. 31, Rear Panels Folded FIG. 32))

This embodiment of the invention may have a Front Panel (F1) wider than a Rear Panel (B1) and Rear Side Panels (L2 and R2) wider than Front Side Panels (L1 and L2). This creates a display with a deeper depth than Variant One with the same width of Front Panel, which increases stability. To erect the display the side panels (L1, L2, R1, R2) are pushed inwards and smoothed into place. The display may be joined together by a Glue Panel (G1 FIG. 23, FIG. 25, FIG. 26) or tab and slot panel device (FIG. 48) or any other joining device.

Figure 31:
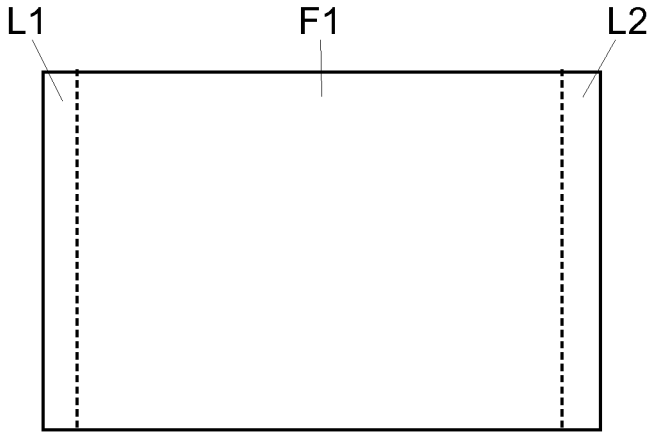
Figure 32:
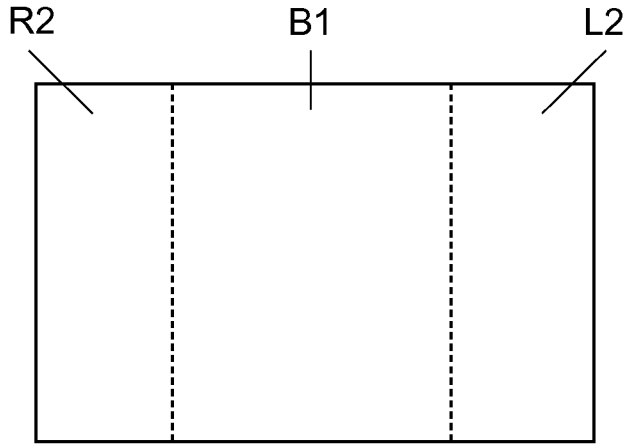
Figure 33:
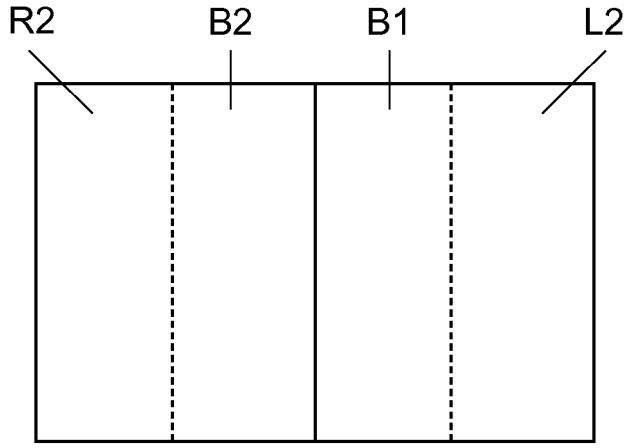

Embodiment Two (Front View FIG. 27, Rear View FIG. 28, Panel Layout FIG. 29, Flat Assembly Diagram FIG. 30, Front Panels Folded FIG. 31, Rear Panels Folded FIG. 33)

This embodiment of the invention is the same as Embodiment One but has no Glue Panel, instead the Rear Panel is divided vertically down the middle into a Left Rear Panel (B1 FIG. 28) and a Right Rear Panel (B2 FIG. 28) that are folded over and fixed to the back of the Front Panel (F1) at points along the Glue Seams or along the entire length of the Glue Seams (G1 and G2, FIG. 29) to aid automated manufacture.

Figure 34:
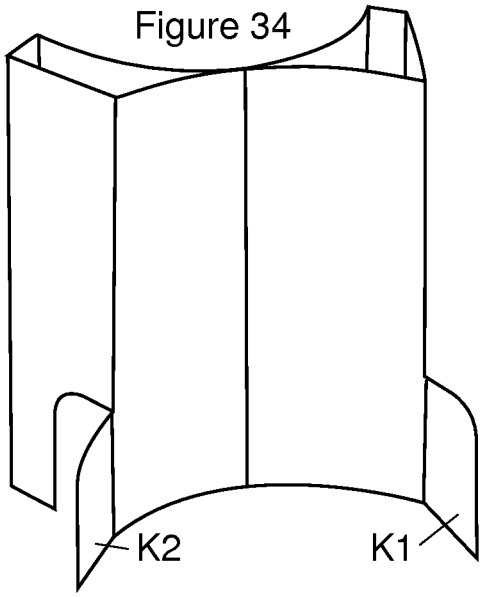

Embodiment Three (Rear View FIG. 34)

This embodiment of the invention is the same as Embodiments One and Two but with stabilizers (K1 and K2) formed from die-cuts in the Rear Side Panels (L2 and R2).

Figure 35:
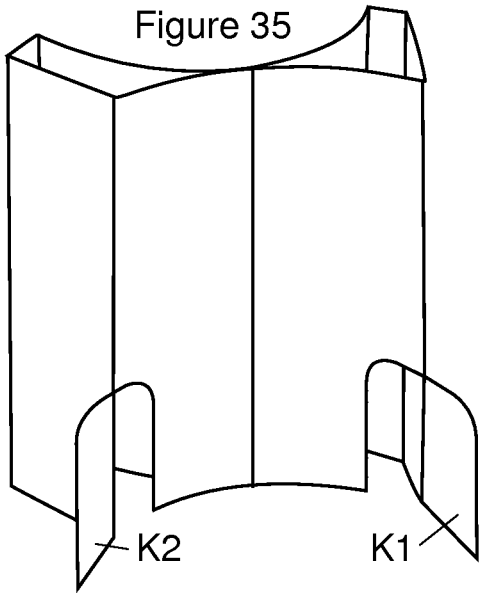

Embodiment Four (Rear View FIG. 35)

This embodiment of the invention is the same as Embodiments One and Two but with stabilizers (K1 and K2) formed from die-cuts in the Rear Panels (B1 and B2).

Figure 44:
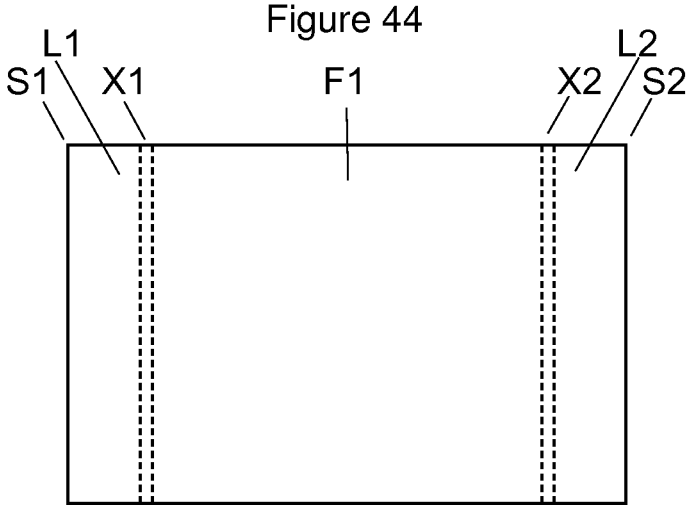
Figure 45:
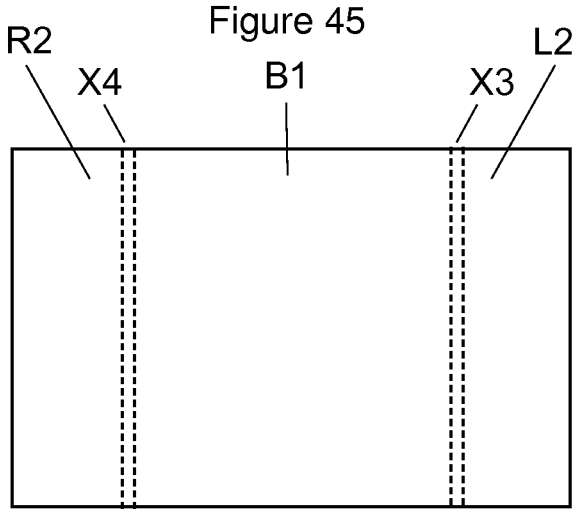
Figure 47:
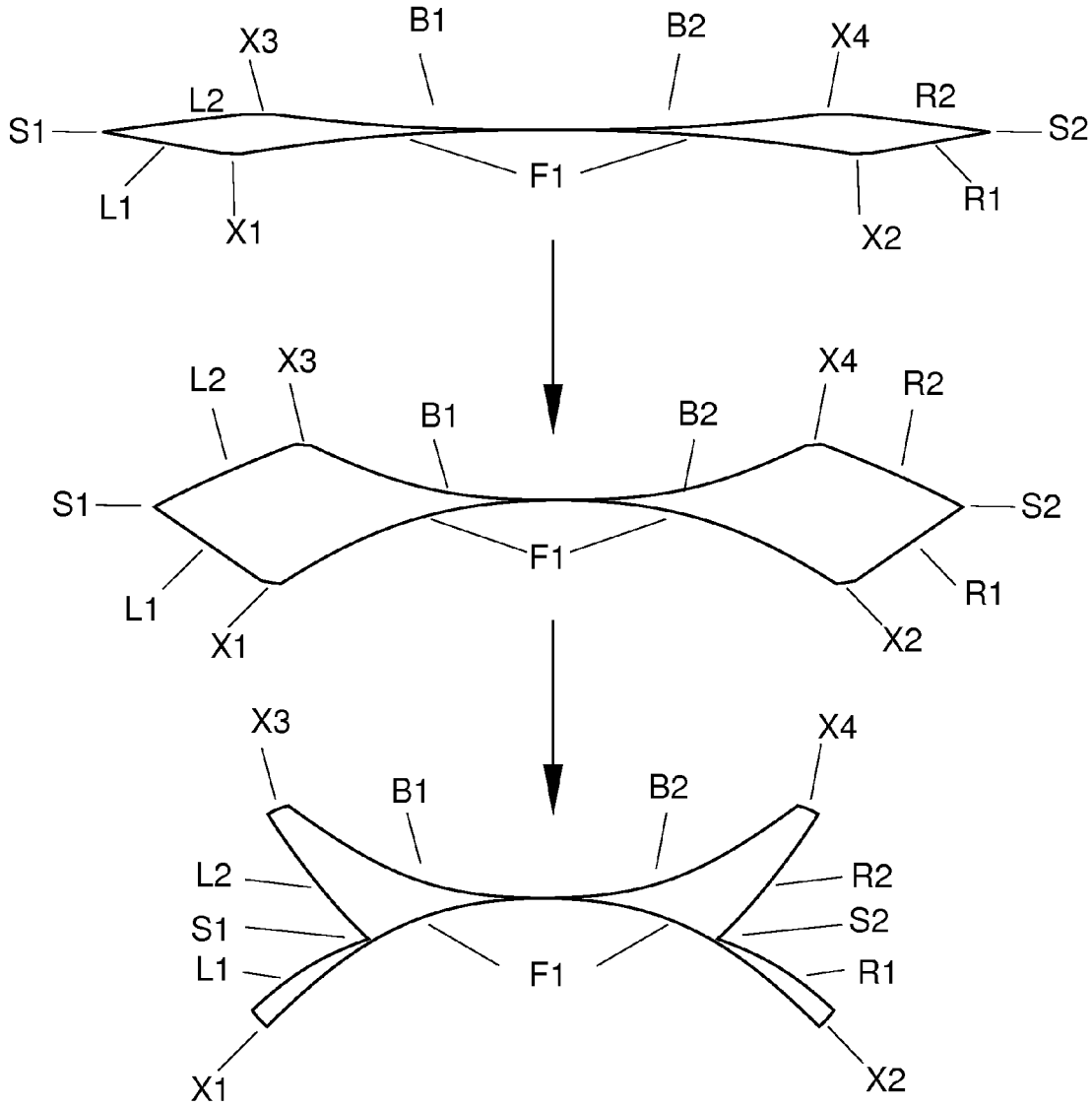

Embodiment Five (Front View FIG. 36, Rear View FIG. 37, Panel Layout FIG. 38, Flat Assembly Diagram 39, Front Panels Folded FIG. 44, Rear Panels Folded FIG. 45, Snap Lock Erection Plans FIG. 47)

This embodiment of the invention has a Front Panel (F1) that may be wider than the Rear Panel (B1) and has Rear Side Panels (L2 and R2) that are wider than the Front Side Panels (L1 and R1). The dimensions of the Rear Side Panels relative to the dimensions of the Front Side panels and the dimensions of the Rear Panel (B1) together with the stiffness of the board are such that when pushed inwards the side panels snap past a point of no return and into a position creating a rigid display. Double fold lines may also be employed producing extra panels (X) to allow the material to fold back upon itself. The display may be joined together by a Glue Panel (FIG. 1 G1) or tab and slot panel device (FIG. 48) or any other joining device.

Figure 40:
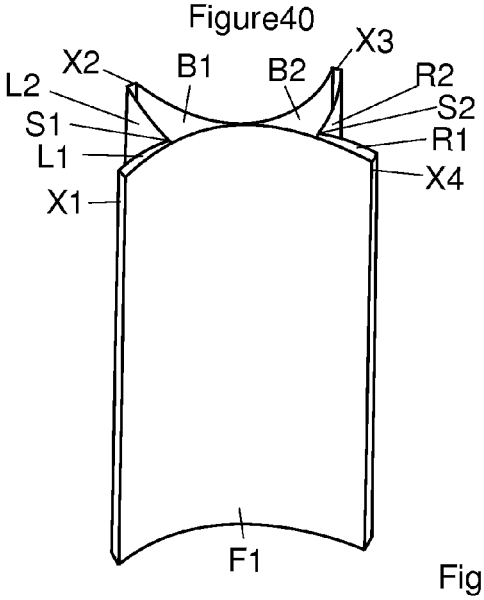
Figure 41:
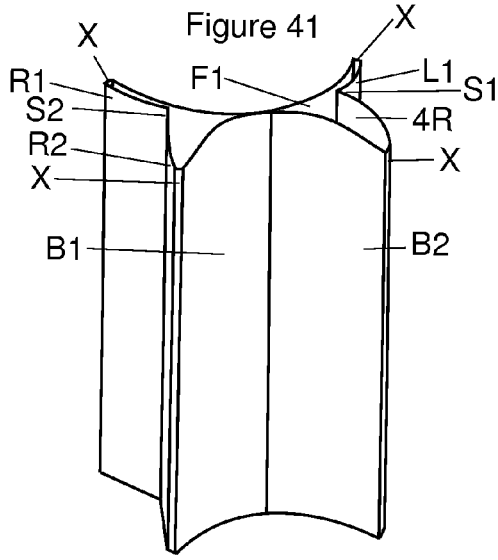
Figure 42:
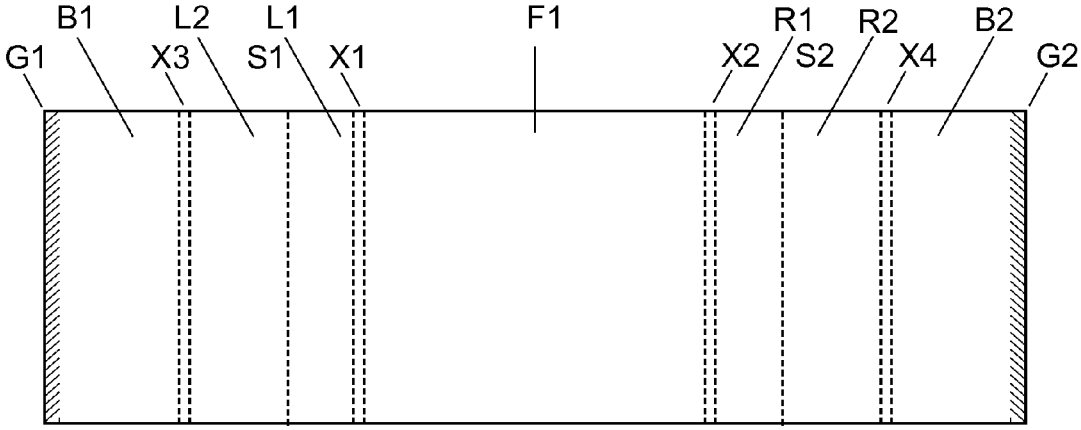
Figure 46:
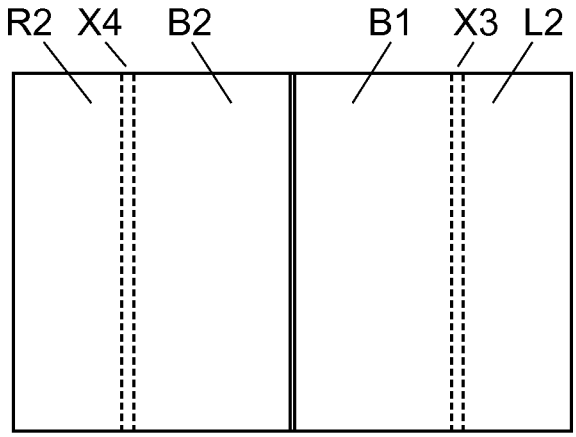

Embodiment Six (Front View FIG. 40, Rear View FIG. 41, Panel Layout FIG. 42, Flat Assembly Diagram 43, Front Panels Folded FIG. 44, Rear Panels Folded FIG. 46)

Figure 43:
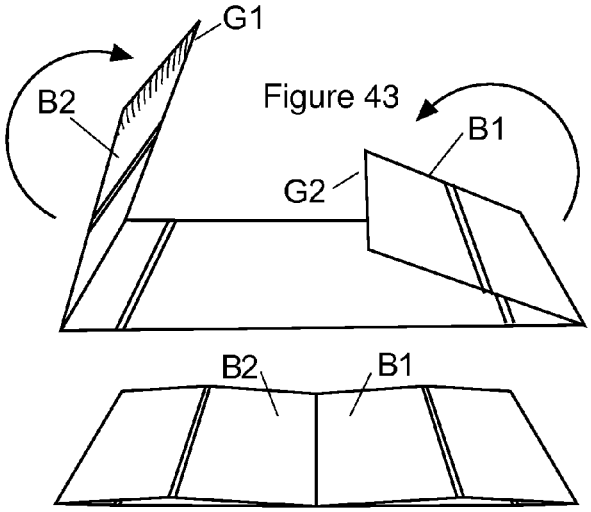

This embodiment of the invention is the same as Embodiment Five but has no Glue Panel, instead the Rear Panel is divided vertically down the middle into a Left Rear Panel (B1) and a Right Rear Panel (B2) that are folded over and fixed to the back of the Front Panel (F1 FIG. 41, FIG. 42, FIG. 43) at points along the Glue Seams or along the entire length of the Glue Seams (G1 and G2, FIG. 42) to aid automated manufacture.

The invention claimed is:

1. A concave display unit formed from at least one sheet of foldable and bendable material subdivided into panels to form a front panel, a rear panel, the front panel being directly fixed to the rear panel, and a pair of opposing sets of side panels, each set of side panels comprising a front side panel and a rear side panel, wherein the front panel and rear panel are of different widths and the front side panels are of different widths to the rear side panels to provide a concave display unit which is collapsible for transport and expandable having concave front and rear panels for display.

2. A concave display unit as in claim 1 where the panels are all of the same height.

3. A concave display unit as in claim 1 wherein the rear panel comprises two half panels and the front panel is fixed to the edge of each half panel to thereby form the rear panel.

4. A concave display unit as in claim 1 wherein each set of side panels comprises at least one further front or rear extra side panel.

5. A concave display unit as in claim 4 wherein the width of the extra side panels allows the sheet to bend back on itself and snap into position to create a rigid display unit when expanded.

6. A concave display unit as in claim 1 wherein the total width of the rear panel plus all the rear side panels is equal to the total width of the front panel plus all the front side panels.

7. A blank for forming a concave display unit, the blank comprising a sheet of foldable and bendable material subdivided into panels to form a front panel, a rear panel and a pair of opposing sets of side panels, each set of side panels comprising a front side panel and a rear side panel, the front panel and rear panel being of different widths and the front side panels being of different widths to the rear side panels, and at least one glue strip for attaching the front panel to the rear panel.

* * * * *